US006516543B1

(12) United States Patent
Bishop et al.

(10) Patent No.: US 6,516,543 B1
(45) Date of Patent: Feb. 11, 2003

(54) SNOW GROOMING APPARATUS AND SYSTEM

(75) Inventors: Thomas Bishop, Belmont, NH (US); J. Douglas Irving, Gilford, NH (US)

(73) Assignee: Gunstock Area, Gilford, NH (US)

( * ) Notice: Subject to any disclaimer, the term of this patent is extended or adjusted under 35 U.S.C. 154(b) by 0 days.

(21) Appl. No.: 09/707,712

(22) Filed: Nov. 7, 2000

(51) Int. Cl.[7] ..... E01H 4/00
(52) U.S. Cl. ..... 37/219
(58) Field of Search ..... 37/219, 220, 221, 37/225, 241, 281, 274; 249/66, 741

(56) References Cited

U.S. PATENT DOCUMENTS 323,433 A * 8/1885 Leeds
2,752,631 A * 7/1956 Wendt
4,306,362 A * 12/1981 Waterman
4,651,450 A * 3/1987 York et al.
5,016,366 A * 5/1991 Watson

* cited by examiner

*Primary Examiner*—Thomas B. Will
*Assistant Examiner*—Kristine Markovich
(74) *Attorney, Agent, or Firm*—Michael J. Persson

(57) ABSTRACT

A snow grooming apparatus and system for grooming snow barriers and elements. The apparatus has an inlet to accept the snow, and at least one smoothing member attached to the rear of the inlet. The smoothing members are dimensioned to pass over the snow formed by the inlet and to smooth at least one side of the snow such that the resulting barrier has at least one substantially smooth side. The system includes the snow grooming apparatus attached to a blade of a snow grooming vehicle.

20 Claims, 6 Drawing Sheets

SNOW GROOMING APPARATUS AND SYSTEM

FIELD OF THE INVENTION

The present invention relates to the field of snow grooming, and in particular, to a snow grooming apparatus and system for forming snow barriers and elements.

BACKGROUND OF THE INVENTION

Skiing has been a popular winter pastime for many years. In recent years the costs of snow making and area upkeep have left ski areas looking for ways to attract additional revenue from their investment. Accordingly, ski areas have expanded to include cross-country ski trails, snow shoe and ice skating areas, and elaborate snowboard parks.

One development in this trend has been the proliferation of snow tubing parks at ski areas. These parks are attractive because they provide an attraction for non-skiers who may accompany their families to the ski area. Snow tubing parks are typically divided into lanes that run parallel to one another from the highest to the lowest elevation. Such an arrangement of lanes allows maximum use of the park, reduces the chance of collisions between tubers, and allows the ski slope operators to segregate snow tubers by age, ability or other considerations.

Snow tube lanes are generally separated by barriers that are of sufficient height to constrain the snow tubes. These barriers may be constructed in many ways. For example, in some tubing parks barriers are formed with bales of hay, which are placed along the sides of the lanes. This use of hay bales does not require a large initial investment, but is costly due to the need to continuously purchase hay bales and the need to hire additional personnel to see that the hay bales remain in place during operation. In other tubing parks the ground under the snow is formed into a barrier that is subsequently covered by snow. However this method requires a larger initial investment in construction and limits the area's ability to groom the tubing lanes using existing grooming equipment.

The most popular method of forming barriers has been to use the snow on the ground to construct the barriers that form the lanes. This is achieved by plowing the snow on the slopes with a conventional snow vehicle to which a blade is mounted, in order to form snow banks similar to snow banks formed on the side of the road after a snowstorm. This method is preferred because it utilizes existing ski area grooming equipment, does not require a large initial investment in construction, eliminates the continuing cost of purchasing hay bales and maintaining their position, is friendly to the environment, and allows the ski area to groom the tubing lanes creating lanes of uniform size. This method, however, is not without its problems.

One significant problem with this method is insuring the safety of tubers who impact the barriers. When a barrier is created by a snowcat blade the resulting surface will typically include a number of ragged edges, which become sharp when softened by the sun and refrozen. Because there is no effective way of steering the snow tube, there is no real control over the descent down the snow tube lane. Accordingly, it is not uncommon for the head or face of a snow tuber to contact the barrier during descent. As a result of this danger, it is often necessary for staff to visually inspect each barrier and manually smooth sharp edges and/or large chunks of snow along the barriers. Further, in cases where there are too many edges and/or chunks to manually smooth, it is often necessary for the snow vehicle to flatten the barriers and reform them, causing additional labor to be expended.

There are a number of prior art methods for forming snow. However, none are adapted to solve the present problem. For example, U.S. Pat. No. 5,016,366 teaches a method for creating snow barriers in fields. In this patent, a row of snow is severed from the snow cover and elevated to provide a trench in the snow cover. The row is then deflected to one side of the trench and deposited on the undisturbed snow covering beside the trench. This produces a wind barrier on the snow-covered field, and a system that ridges snow in fields. However, the apparatus is not adapted to the topography of a snow-tubing park.

U.S. Pat. No. 4,356,645 discloses a variable wing plow blade and mounting structure for attaching the plow blade to a tractor, snow grooming vehicle and the like. Such that a blade distributes the load over a relatively large area. In addition, the height of the plow blade, and pitch and roll, tilt and wing blade adjustments, to offer greater freedom of movement of the blades. Although this plow effectively moves the snow, it does not solve the problem of icy, jagged snow barriers.

An apparatus that allows lanes of snow in a snow tube park to be groomed in such a manner as to prevent the formation of jagged edges is not known in the art.

SUMMARY OF THE INVENTION

The invention is a lane grooming apparatus and system that accepts a quantity of snow and forms the quantity of snow into a smooth sided barrier that is used to separate a snow tube area into lanes, or to form elements upon a ski slope.

In its most basic form, the apparatus of the present invention has an inlet to accept the snow, and at least one smoothing member attached to the rear of the inlet. The smoothing members are dimensioned to pass over the snow formed by the inlet and to smooth at least one side of the snow such that the resulting barrier has at least one substantially smooth side.

In some embodiments of the apparatus, two smoothing members are attached to, and extend from, the rear of the inlet. In its preferred form, however, the apparatus utilizes three smoothing members. In this embodiment, the inlet is substantially trapezoidal and includes a top, a first side and a second side. Each of the sides are tapered inward such that the front of the inlet is larger than the rear of the inlet. It is preferred that the three smoothing members be constructed of a substantially flexible material. These flexible smoothing members are preferably attached to the inlet and are held in contact with the snow barrier by a plurality of springs. The preferred apparatus also includes an attachment that permits the apparatus to be removably attached to a snow grooming blade.

In its most basic form, the system of the present invention includes the snow grooming apparatus and the apparatus is attached to a blade that is dimensioned for attachment to a snow grooming vehicle. In its preferred form, the grooming system includes a snow grooming apparatus that is removably attached to one side of a snow grooming blade. The preferred snow grooming blade includes a center blade with a curved bottom edge, a first side of the blade, disposed next to the apparatus, having a curved bottom, and a second side of the blade, disposed opposite from the first side of the blade, having a standard grooming edge. In the preferred system, the apparatus is attached to the blade via a first pair of steel box beams welded to the outside of one side of the inlet. The first pair of beams is inserted into a second pair of box beams, which have an inside dimension larger than the outside dimension of the box beams that are welded to the apparatus. The second pair of box beams is preferably welded to the plow blade. The first pair of beams is preferably secured within the second pair of beams via a pair of steel pins that are inserted through holes drilled at predetermined locations through both pairs of beams. These steel pins are preferably secured with clips or cotter pins. The apparatus of the preferred system also includes a steel plate that is dimensioned to fit in the space between the apparatus and the snow-grooming blade.

In operation, the apparatus is attached to the blade and the blade is attached to a grooming vehicle. The grooming vehicle then lowers the blade to the desired height and propels the blade and apparatus forward to form a lane. During the process of forming the lane, snow is received by the inlet of the apparatus. The inlet forms the snow into a barrier bounding the lane. The barrier then exits the inlet and is smoothed by the smoothing members such that the resulting barrier has at least one substantially smooth surface.

Therefore, it is an aspect of the present invention to provide an apparatus and system for forming and smoothing a snow barrier.

It is a further aspect of the invention to provide a snow grooming apparatus for forming snow barriers, which can be used with existing snow grooming technology.

It is a further aspect of the invention to provide a snow grooming apparatus that may be removably attached to common snow grooming blades.

It is a further aspect of the invention to provide a system for forming snow barriers that enhances the safety of users by producing snow barriers having at least one substantially smooth side.

It is a still further aspect of the invention to provide a system for forming snow barriers that includes a blade that is dimensioned to form a lane having a curved bottom.

These aspects of the invention are not exclusive and other features, aspects, and advantages of the present invention will be readily apparent to those of ordinary skill in the art when read in conjunction with the following description, appended claims and accompanying drawings.

DETAILED DESCRIPTION OF THE DRAWINGS

Figure 1:
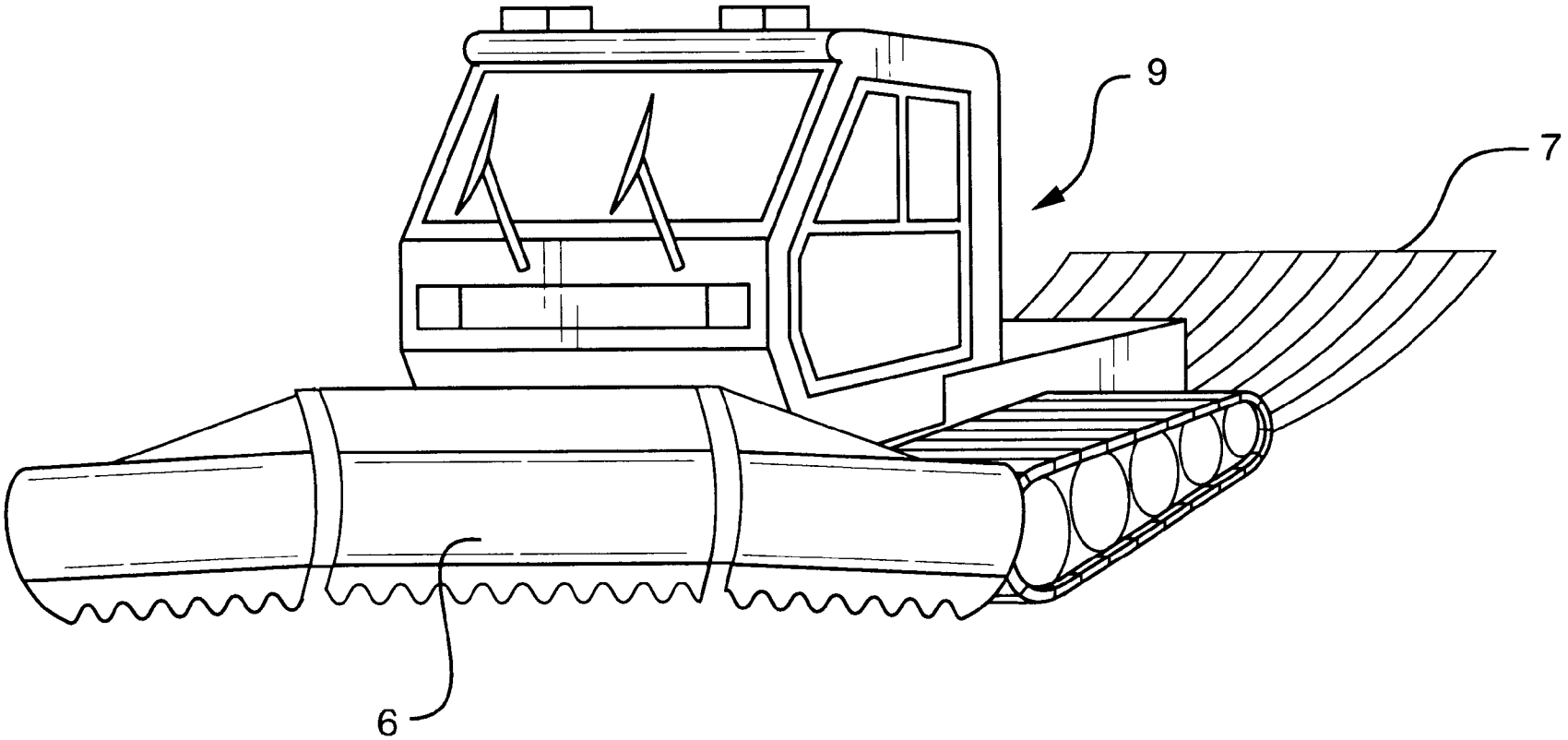
FIG. 1 is an isometric view of a prior art grooming vehicle and blade.

Referring first to FIG. 1, a prior art snow grooming vehicle 9 is shown. As described above, the snow grooming vehicle 9 is a vehicle such as those manufactured by the Kassbohrer, GmBh of Germany an marketed under the trademark "PISTEN BULLY". A snow grooming blade 6 is typically attached to the front of the vehicle and may be raised and lowered into position by a hydraulic lift system (not shown) disposed at the front of the vehicle 9.

The prior art grooming vehicle 9 and blade 6 described in FIG. 1 has traditionally been used for grooming ski slopes. The method of grooming is such that the snow in front of the blade 6 is broken up by the serrated leading edge of blade 6 as the blade passes 6 over it. The snow is then smoothed by smoothing members 7 attached at the rear of the snow grooming vehicle. When the prior art grooming equipment 9 is used to form barriers between snow tube lanes, the blade 6 will be lowered to the desired height and angled to push the snow to one side, creating the snow barrier.

Figure 2:
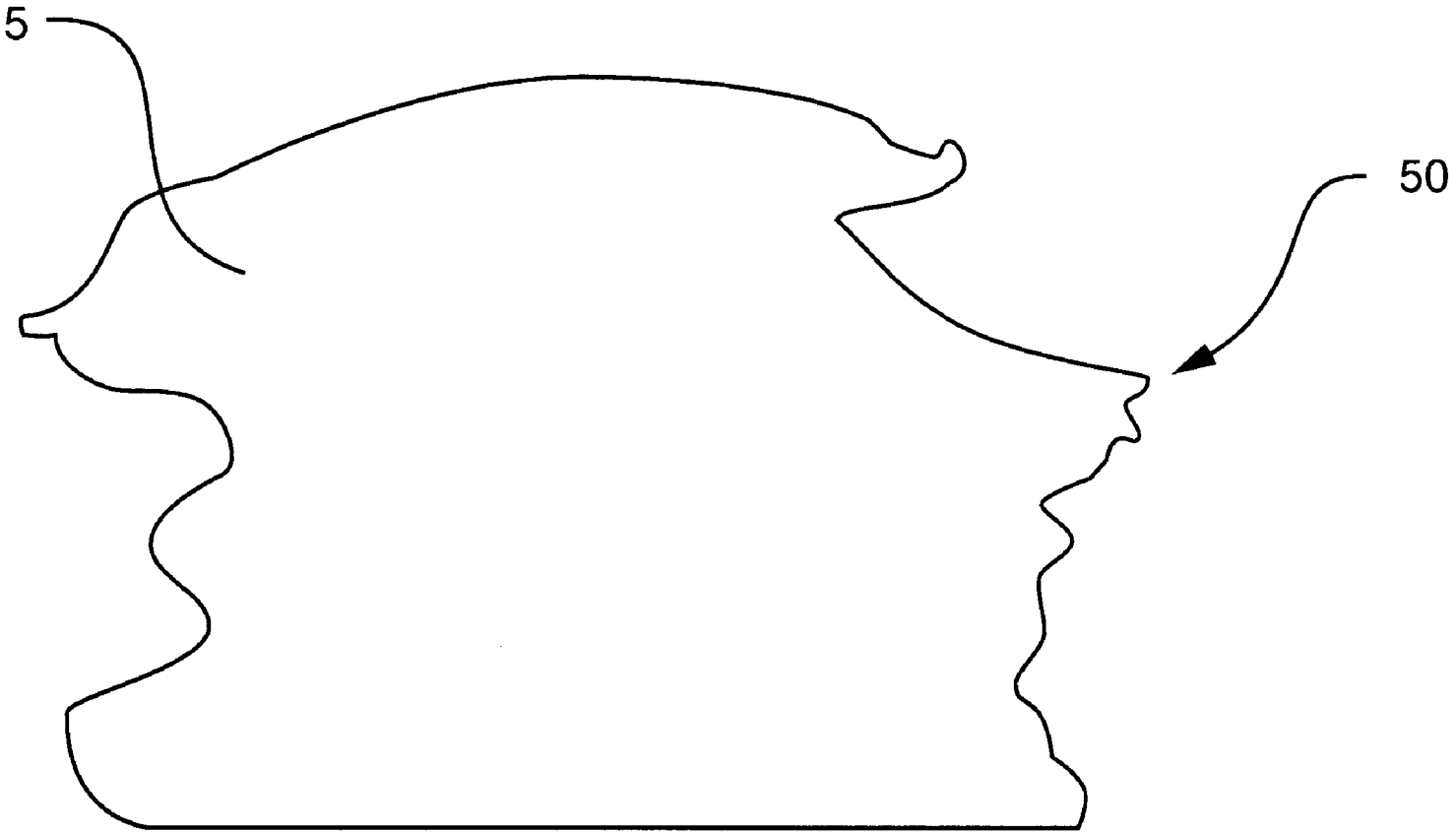
FIG. 2 is a cut away end view of a snow barrier left by the prior art grooming system of FIG. 1.

Prior art grooming equipment, such as the grooming vehicle 9 and blade 6 of FIG. 1, works well on ski slopes. However, as noted above, it is not preferred for use in snow tube areas due to the fact that it leaves the snow tube areas with an essentially flat surface and snow barriers having jagged sides. This result is shown in FIG. 2, which is a cut away end view of a snow barrier 5 left by the prior art grooming vehicle 9 and blade 6. The jagged edges 50 result from the freezing and thawing of the barrier after it is formed. As noted above, these jagged edges 50 are unacceptable due to the risk of injury from contact with the jagged edges 50 of the barrier 5, and, consequently, to the increased labor expended to eliminate this risk.

Figure 3:
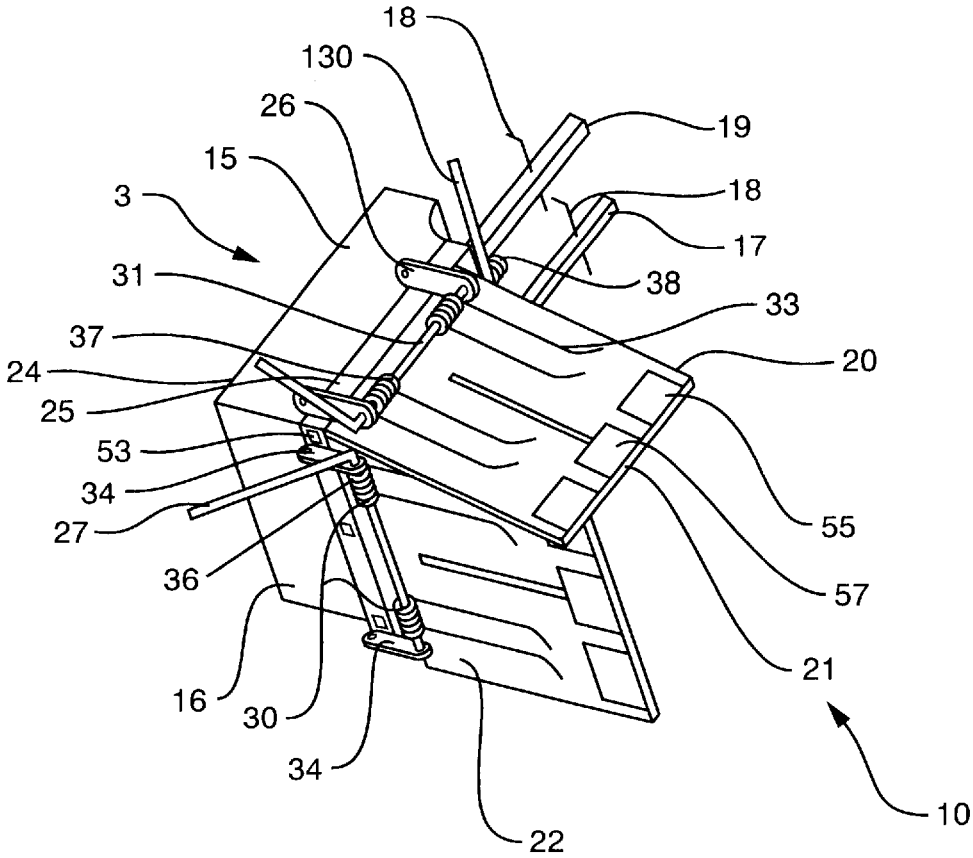
FIG. 3 is a top rear isometric view of the grooming apparatus of the present invention.
Figure 4:
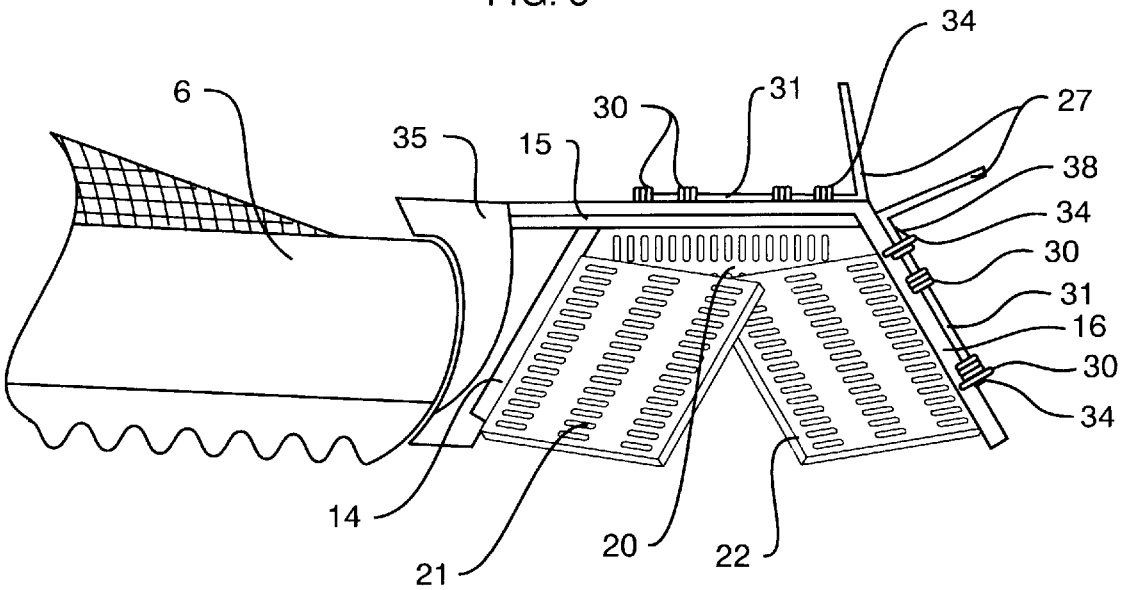
FIG. 4 is a front isometric view of the grooming apparatus of the present invention removably attached to a snow grooming blade.

Referring to FIGS. 3 and 4, the preferred lane grooming apparatus 10 of the present invention is shown. The preferred apparatus 10 includes an inlet 3 having a top 15, a plurality of sides 14, 16, and at least one smoothing member 20, 21, 22 attached to, and extending from, the rear of said inlet 3.

In the preferred embodiment, the sides 14, 16 are angled outward from the top 15 such that the inlet 3 substantially forms a trapezoid without a bottom member. In this preferred embodiment, the top 15 is approximately eighteen inches wide and is eighteen inches from the base of each side 14, 16, and the distance between the base of each side 14, 16 is approximately forty inches. This arrangement is preferred as it allows a sloped barrier to be formed. A sloped barrier is preferred as it allows a tube to gently deflect back into the lane rather than violently colliding with the barrier. In addition, by sloping the barrier at an angle greater than an angle of repose of the snow, the snow at the top of the barrier is less likely to separate and fall towards the base of the barrier.

Although it is preferred that the sides 14, 16 are angled outward to form a trapezoid, it is recognized that other embodiments may utilize sides 14, 16 that are proportioned to create a triangular or rectangular inlet. In other embodiments, the inlet 3 is formed of a single semicircular or parabolic side 14. In other embodiments, the inlet 3 may take other shapes, provided such shape will allow snow to enter the apparatus 10 and form a snow barrier when the snow exits the apparatus 10. In still other embodiments, a forming insert is disposed with the inlet for forming the snow into a predetermined shape. Such a forming insert is attached via welding, bolting or other art recognized attachment means and acts to extrude the snow into a desire shape.

The top 15 and sides 14, 16 of the preferred inlet 3 are dimensioned such that the inlet 3 has a front opening 24 that is substantially larger than its rear opening 25. This arrangement is preferred as it allows the snow to be compacted as it passes through the inlet 3. However, it is recognized that other embodiments may utilize an inlet 3 that has a front opening 24 and rear opening 25 that are of substantially the same shape. In some of these embodiments, compaction of the snow is achieved through the action of the smoothing members 20, 21, 22. In others, the snow is compacted via both the smoothing members 20, 21, 22, and by the melting of the snow at the surface via a water injection system attached to the inlet. Such a system would preferably spray heated water from the rear of the inlet in order to compact dry snow, but would be adapted to allow the spray of water to be stopped when forming wet snow. In still other embodiments, the exterior of the barrier is melted by heating the inlet. Such heating may be accomplished through electrical induction or other heating means and acts to compact the outer surface of the barrier.

Finally, the preferred inlet 3 is manufactured of steel, due to its high strength and weldability. However, it is recognized that the inlet 3 may be manufactured from other art recognized materials, provided that the materials provide sufficient strength to allow the inlet 3 to form heavy snow without breaking or distorting.

The smoothing members 20, 21, and 22 are attached to the rear of the inlet 3 by art recognized means such as bolts 53, rivets or the like. In the preferred embodiment, these smoothing members 20, 21, 22 are manufactured of the same urethane material that is used to form the smoothing members at the rear of the prior art grooming equipment. These preferred smoothing member 20, 21, 22 are approximately one half inch thick and include ridges that increase the total thickness to approximately one inch. In the preferred embodiment, the smoothing members 20, 21, 22 are manufactured by modifying grooming pads, such as those manufactured by Kassboherer, GmBh, and sold under part number 819-63.00.113-043. These are preferred due to their ready availability and proven durability in cold environments. However, smoothing members 20, 21, 22 may be custom manufactured of other materials, such as natural or synthetic rubber, plastics, or the like, provided that the material will provide the necessary smoothing action and will withstand the low temperatures and abrasion encountered during snow grooming. In addition, in embodiments where the smoothing members 20, 21, 22 are custom manufactured, it is preferred that the weights 57 be eliminated from the trailing edges of the members 20, 21, 22.

In the preferred apparatus 10, the smoothing members 20, 21, 22 include a plurality of ridges 55 on the surface of each member 20, 21, 22 that is not in contact the snow. These ridges 55 act to stiffen the smoothing members 20, 21, 22, such that they are less likely to flex during use. In addition, the ability of the ridges 55 to fill voids in the surface of the barrier makes them preferred. However, in embodiments utilizing substantially stiff smoothing members 20, 21, 22, or those in which the smoothing members 20, 21, 22 are tensioned along their entire length, these ridges 55 may be eliminated.

The smoothing members 20, 21, 22 of the preferred apparatus 10 are tensioned against the snow exiting the inlet 3 by means of springs 30. The preferred springs 30 are constructed such that each spring body 37 is removably attached to a spring bar 31, via bolts or other conventional attachment means, to allow the tine 33 of the spring 30 to extend away from the spring body. In this arrangement, the spring tines 33 maintain contact with the grooming members 20, 21, and 22 and force them against the snow barrier exiting the inlet 3 so as to smooth any jagged edges upon the sides of the barrier. The preferred springs 30 are manufactured of cylindrical spring steel having a diameter of approximately 0.35 inches (9 mm) and include a body 37 made up of two spring sections, each forming four turns of approximately two and one half inches in diameter. A tine 33 extends a distance of approximately twelve inches from each section of the spring body 37 where it contacts the smoothing member 20, 21, 22. The preferred springs 30 exert a force of between ten and twenty pounds per inch of deflection, when measured at the end of the tine 33. However, it is recognized that other embodiments, may utilize different springs 30, which exert different ranges of force, to achieve similar results.

The spring bars 31 are preferably attached to the inlet 3 of the apparatus 10 by means of gusset plates 34 that are welded to the inlet body 3. The gusset plates 34 are designed to removably hold the spring bars 31 and to allow the spring bars 31 to be incrementally positioned so as to maintain a predetermined tension on the grooming members 20, 21, and 22. Such an incremental positioning is preferred in order to account for variations in the density of the snow being groomed. In the preferred embodiment, this incremental position is achieves through the use of travel arms 27, which are attached to the top of the spring bars 31 and are used to move the spring bars 31 to a desired tension position. In such an arrangement, the spring bars 31 are moved to the desired position and preferably secured by pins 36 placed in holes drilled in gusset plates 34 and tension plates 38. However, it is recognized that other means, such as gears, hydraulics, screws, or the like, may also be utilized to position the springs.

Although the use of a cantilever type tensioning spring 30 is preferred, it is recognized that the smoothing member 20, 21, 22 in other embodiments may be tensioned by means of hydraulics or pneumatics. In such an embodiment, a plurality of cylinders (not shown), similar to shock absorbers, are attached to the smoothing members 20, 21, 22 to allow movement of the smoothing members 20, 21, 22 while providing a force against the snow exiting the apparatus 10. It is noted that, in these embodiments, it would be preferred to utilize a hydraulic cylinder due to the provision of hydraulic connections on common snow vehicles.

In some embodiments, a vibratory system is attached to the smoothing members 20, 21, 22 in order to further compact the snow. In such an embodiment, a plurality of vibratory motors (not shown) are placed in contact with the smoothing members 20, 21, 22 and are caused to vibrate. This vibration is transmitted through the smoothing members 20, 21, 22 and acts to compact the sides of the barrier.

Figure 5:
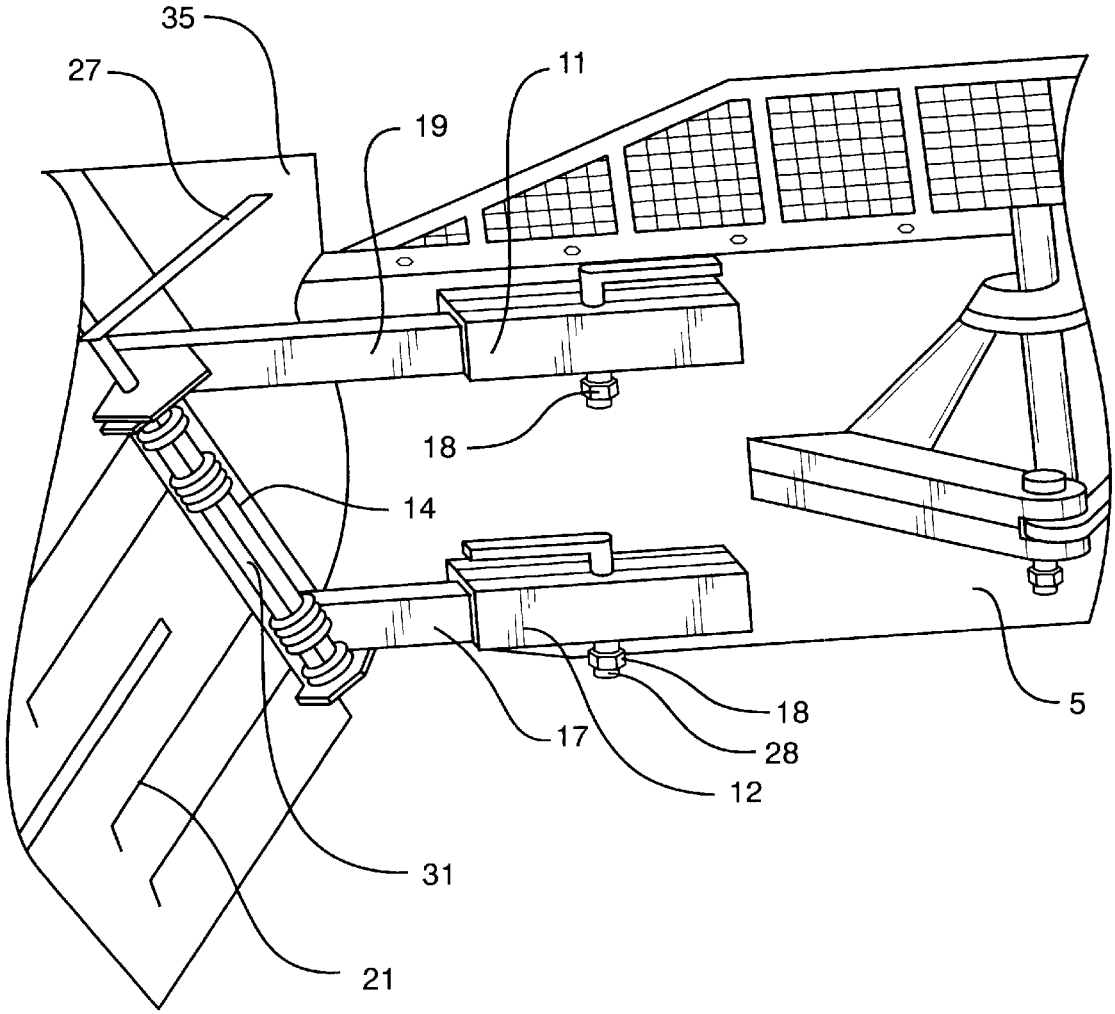
FIG. 5 is a rear isometric view of the system of the present invention showing the preferred means for attaching the apparatus to the blade.

The apparatus 10 of the present invention is adapted for attachment to a blade 6 on a conventional grooming vehicle 9. As shown in FIGS. 3 and 5, the apparatus 10 is preferably attached to the snow plow blade 6 via a pair of box beams 17 and 19. In this embodiment, box beams 17, 19 are attached to the one side 14 of the inlet 3 and dimensioned for insertion within a pair of mating box beams 11 and 12 that are attached to the snow plow blade 6. The box beams 17, 19 are preferably removably attached to the mating box beams 11 and 12 via locking pins 18, which are inserted through holes drilled through corresponding locations in both the box beams 17, 19 and the mating box beams 11, 12 and removably secured via clips 28.

In the preferred embodiment, box beams 17, 19 are welded to the side 14 of the inlet 3 and mating box beams 11, 12 are welded to the blade 6. However, it is recognized that, in other embodiments, the box beams 17, 19 and mating box beams 11, 12 may be attached to the apparatus 10 and snow plow blade 6 via by bolting or other conventional attachment means. In other embodiments, the box beams 17, 19 are replaced by shafts (not shown) in the mating box beams 11, 12 are replaced by mating members dimensioned to accept the shafts. In still other embodiments, the apparatus 10 is not fixedly attached to the blade 6 via welding.

Referring again to FIG. 4, the preferred embodiment of the present invention includes a transition piece 35 that is dimensioned to span the gap between the apparatus 10 and the plow blade 6. The inclusion of such a transition piece 35 is preferred as it prevents snow from escaping between the apparatus and blade 6. The transition piece 35 is preferably attached to side 14 of the inlet 3 by welding. However, in other embodiments, this connection can be made by bolting, pinning, or by other art recognized means.

Figure 6:
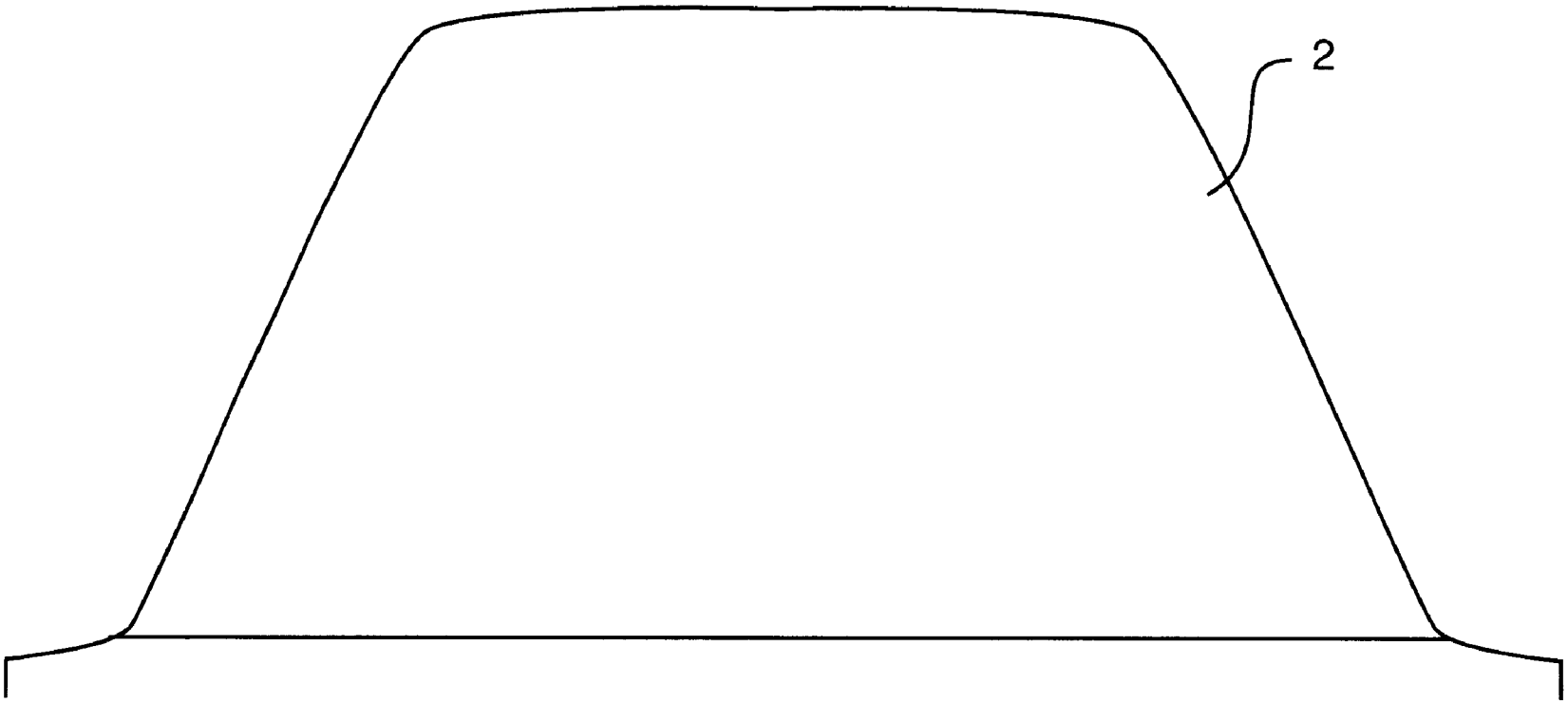
FIG. 6 is a cut away end view of a snow barrier left by the grooming apparatus of the present invention.

In operation, the grooming apparatus 10 is lowered into position and is moved through the snow. The snow enters the front of the inlet 3 and is compacted into the desired form by the top 15 and sides 14, 16. Once the snow has passed through the rear of the inlet 3, it comes into contact with the smoothing member 20, 21, 22, which smooth any jagged edges. The resulting snow barrier 2 is shown in FIG. 6. As shown in FIG. 6, the snow barrier 2 formed by apparatus 10 includes substantially smooth sides, which are free from jagged edges.

Figure 7:
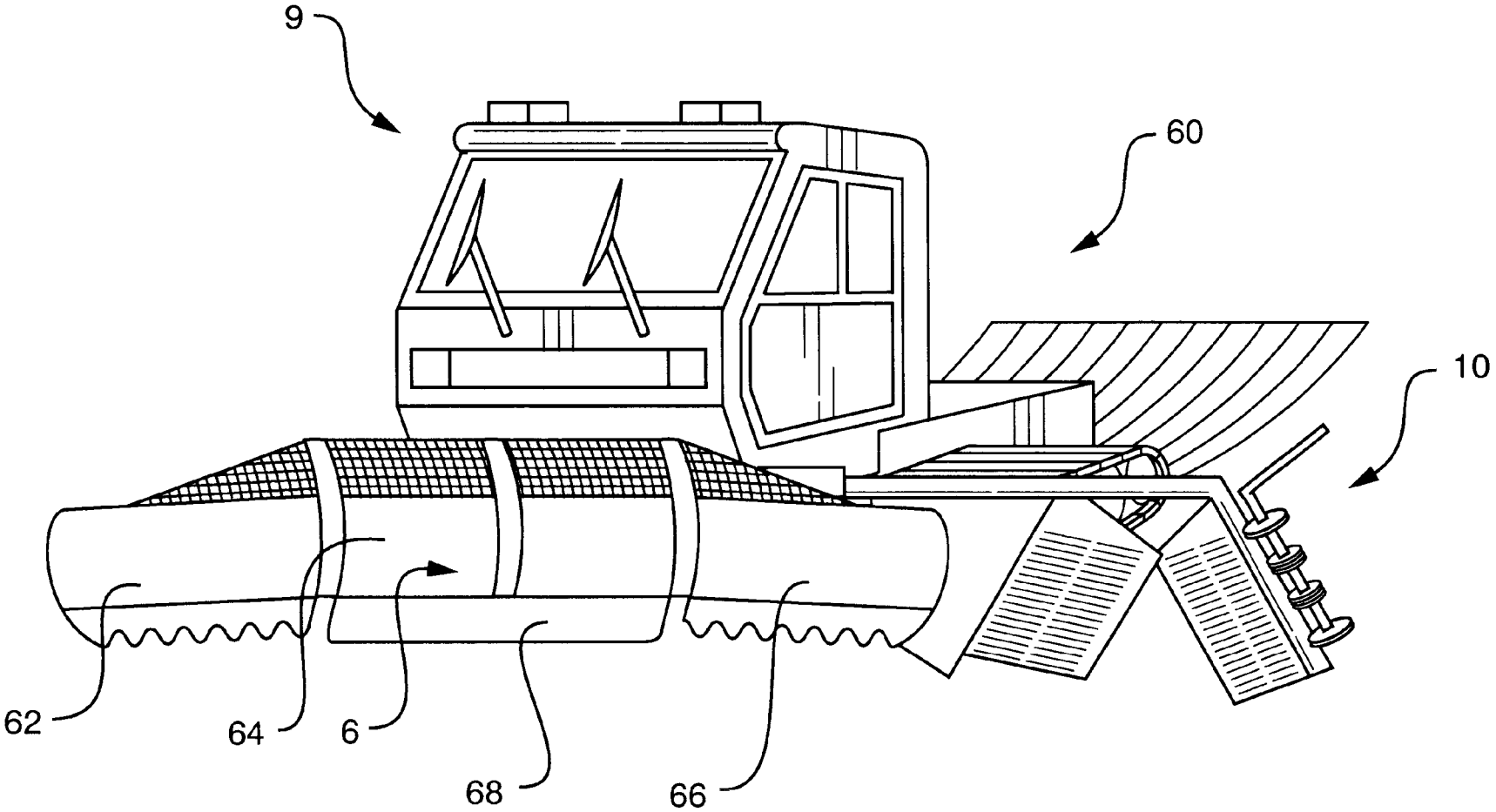
FIG. 7 is a front isometric view of the grooming system of the present invention.

Referring to FIG. 7, a front pictorial view of the preferred system 60 of the present invention is shown. The system includes a snow grooming vehicle 9, a blade 6 and a grooming apparatus 10. The snow plow blade 6 has three sections 62, 64, 66 that are connected to each other and to the snow grooming vehicle 9. In the preferred system the center section 64 of plow blade 6 and the section 66 of the blade 6, to which the apparatus is attached, has a curved bottom 68. The curved bottom 68 of the blade 6 more effectively gathers the snow to be used in the preferred embodiment of the invention and creates a "dished" effect on the snow tube area. This maintains a geometry that allows the snow tuber to navigate the snow tube lane with more safety than a flat surface would allow.

Although the present invention has been described in considerable detail with reference to certain versions therefore, other versions would be readily apparent to those of ordinary skill in the art. For example, the apparatus 10 is shown herein mounted to a blade 6 of a snow-grooming vehicle 9. However, it is understood that the apparatus could be mounted directly to the vehicle 9, or to a snow mobile (not shown) and passed over a lane formed in the traditional manner. Further, although the preferred embodiment is adapted to groom barriers between snow tube lanes, the apparatus and system are also adapted to forming elements, such a jumps, or the like, on ski slope, snowboard areas or the like. Therefore, the spirit and scope of the appended claims should not be limited to the description of the preferred versions contained herein.

What is claimed is:

1. A grooming apparatus for forming a barrier of snow, said apparatus comprising:

an inlet for receiving and forming a quantity of snow, said inlet comprising a front, a rear, a top, a first side and a second side, and being dimensioned to form the quantity of snow into said barrier; and at least three smoothing members attached to, and extending from, said rear of said inlet, said smoothing members being dimensioned to smooth at least one surface of the barrier;

wherein the quantity of snow is received by said inlet, is formed by said inlet into a barrier, and is smoothed by said smoothing members such that a barrier having at least one substantially smooth surface is formed.

2. The grooming apparatus as claimed in claim 1 wherein said at least one smoothing member is manufactured of a substantially flexible material.

3. The grooming apparatus as claimed in claim 2 further comprising at least one spring for maintaining said at least one smoothing member in contact with said surface of said barrier.

4. The grooming apparatus as claimed in claim 1 wherein said inlet is tapered inward such that said front of said inlet is larger than said rear of said inlet.

5. The grooming apparatus as claimed in claim 4 wherein said front and said rear of said inlet are substantially rectangular in cross section and wherein said inlet further comprises a top, a first side and a second side.

6. The grooming apparatus as claimed in claim 1 further comprising an attachment for attaching said apparatus to a blade of a snow grooming vehicle.

7. The grooming apparatus as claimed in claim 6 wherein said attachment is an attachment for removably attaching said apparatus to said blade.

8. The grooming apparatus as claimed in claim 7 comprising:

three smoothing members attached to, and extending from, said rear of said inlet; and a plurality of springs for maintaining said smoothing members in contact with said surface of said barrier;

wherein said inlet further comprises a top, a first side and a second side, and is tapered inward such that said front of said inlet is larger than said rear of said inlet.

9. A grooming system for forming barriers of snow, said system comprising:

a blade dimensioned for attachment to a grooming vehicle said blade having a first side and a second side; and a grooming apparatus attached to one side of said blade, said grooming apparatus comprising;

an inlet for receiving and forming a quantity of snow, said inlet comprising a front and a rear, and being dimensioned to form the quantity of snow into a barrier; and at least one smoothing member attached to, and extending from, said rear of said inlet, said smoothing member being dimensioned to smooth at least one surface of the barrier;

wherein said blade is attached to the grooming vehicle, is lowered to a desired height and is propelled forward to form a lane and such that a quantity of snow is received by said inlet, is formed by said inlet into a barrier bounding said lane, and is smoothed by said smoothing member such that the barrier has at least one substantially smooth surface.

10. The grooming system as claimed in claim 9, wherein said grooming apparatus comprises at least two smoothing members attached to, and extending from, said rear of said inlet.

11. The grooming system as claimed in claim 10 wherein said inlet of said grooming apparatus further comprises a top, a first side and a second side and wherein said grooming apparatus comprises three smoothing members attached to, and extending from, said rear of said inlet.

12. The grooming system as claimed in claim 9 wherein said at least one smoothing member of said grooming apparatus is manufactured of a substantially flexible material.

13. The grooming system as claimed in claim 12 wherein said grooming apparatus further comprises at least one spring for maintaining said at least one smoothing member in contact with said surface of said barrier.

14. The grooming system as claimed in claim 9 wherein said inlet of said grooming apparatus is tapered inward such that said front of said inlet is larger than said rear of said inlet.

15. The grooming system as claimed in claim 14 wherein said front and said rear of said inlet of said grooming apparatus are substantially rectangular in cross section and wherein said inlet further comprises a top, a first side and a second side.

16. The grooming system as claimed in claim 8 wherein said grooming apparatus is removably attached to said blade.

17. The grooming system as claimed in claim 9 wherein said blade comprises a curved bottom edge.

18. The grooming system as claimed in claim 17 wherein said grooming apparatus comprises:

three smoothing members attached to, and extending from, said rear of said inlet; and a plurality of springs for maintaining said smoothing members in contact with said surface of said barrier; and wherein said inlet of said grooming apparatus further comprises a top, a first side and a second side, and is tapered inward such that said front of said inlet is larger than said rear of said inlet.

19. A grooming apparatus for forming a barrier of snow, said apparatus comprising:

an inlet for receiving and forming a quantity of snow, said inlet comprising a front and a rear, and being dimensioned to form the quantity of snow into said barrier; and at least one smoothing member attached to, and extending from, said rear of said inlet, said smoothing member being manufactured of a substantially flexible material and dimensioned to smooth at least one surface of the barrier; and at least one spring for maintaining said at least one smoothing member in contact with said surface of said barrier;

wherein the quantity of snow is received by said inlet, is formed by said inlet into a barrier, and is smoothed by said smoothing member such that a barrier having at least one substantially smooth surface is formed.

20. The grooming apparatus as claimed in claim 19 wherein said inlet is tapered inward such that said front of said inlet is larger than said rear of said inlet.

* * * * *